US005135465A

United States Patent [19]

Hirahara

[11] Patent Number: 5,135,465

[45] Date of Patent: Aug. 4, 1992

[54] PAPER GUIDE DEVICE

[75] Inventor: Hidefumi Hirahara, Hiroshima, Japan

[73] Assignee: Mitsubishi Jukogyo Kabushiki Kaisha, Tokyo, Japan

[21] Appl. No.: 621,259

[22] Filed: Dec. 3, 1990

[30] Foreign Application Priority Data

Dec. 1, 1989 [JP] Japan ..... 1-310710

[51] Int. Cl.[5] ..... B65H 45/16

[52] U.S. Cl. ..... 493/442; 493/424; 493/445

[58] Field of Search ..... 493/423, 424, 425, 426, 493/427, 428, 429, 430, 431, 432, 433, 434, 435, 442, 443, 444, 445, 419, 420

[56] References Cited

U.S. PATENT DOCUMENTS 1,937,453 11/1933 Wood ..... 493/442
1,937,510 12/1933 Clauberg ..... 493/434 X
2,160,198 5/1939 Clauberg ..... 493/444 X
3,954,258 5/1976 Skipor et al. ..... 493/427 X
4,493,690 1/1985 Niemiro et al. ..... 493/444
4,817,932 4/1989 Stäb et al. ..... 493/424 X

FOREIGN PATENT DOCUMENTS 255352 7/1926 United Kingdom .
351776 7/1931 United Kingdom .

*Primary Examiner*—Bruce M. Kisliuk
*Assistant Examiner*—John A. Marlott
*Attorney, Agent, or Firm*—Wenderoth, Lind & Ponack

[57] ABSTRACT

An improved paper guide device is disposed close to folding rollers in a folding machine of a rotary press as spaced from an outer circumference of a folding drum. During normal operation, the paper guide device is preset to allow for minute movement of the folding rollers during the folding operation. But when the folding rollers clog with paper and move apart beyond a predetermined distance, the paper guide device moves as interlocked with the folding rollers. Therefore, paper guides of the paper guide device never contact the folding rollers. Preferably, the position of the paper guides relative to the folding rollers can be changed such that the widths of the respective gaps between the paper guides and the folding rollers can be adjusted.

5 Claims, 3 Drawing Sheets

PAPER GUIDE DEVICE

BACKGROUND OF THE INVENTION

1. Field of the Invention

The present invention relates to a paper guide device disposed in a folding drum and folding roller section in a folding machine of a rotary press.

2. Description of the Prior Art

FIGS. 3 and 4 illustrate a paper guide device in the prior art.

A multiple web W twice-folded by means of a triangular plate is led via nipping rollers to the nip between a cutting drum 1 and a folding drum 2 to be cut. Then the cut web is folded, by a folding blade 3 projecting from the folding drum 2 and by means of folding rollers 4*a* and 4*b*, and formed into a pull-out binder which is ejected below the folding rollers.

Paper guides 6 and 7 hold the cut web on the outer circumference of the folding drum 2 to eliminate the fluttering of the paper web when it is folded, and also to prevent the production of an unacceptable pull-out binder such as one having folded edges. While the width of a gap between each of the paper guides 6 and 7 and the folding drum 2 can be adjusted to an optimum value depending upon a number of completed pages, during normal operation the widths of the gaps, e.g. $b_1$, is held fixed.

On the other hand, the gap between the folding rollers 4*a* and 4*b* has a width corresponding to the thickness of a number of completed pages of a pull-out binder, and they are operated while undergoing periodical minute movement. They can also move to positions where the gap f can insure the protection of the machine during an abnormal condition such as when clogged with paper. Accordingly, gaps c are respectively reserved between the folding roller 4*a* and the guide 7 such that even if the folding rollers 4*a* and 4*b* should move a distance f they will not come into contact with the paper guides 6 and 7, respectively. Therefore, the gaps c between the folding roller 4*a* and the paper guide 6 and between the folding roller 4*b* and the paper guide 7 during normal operation are chosen considerably broad. It is to be noted that reference numeral 5 designates a support shaft for the paper guide 6, numeral 12 designates a lever which is rotatable about a shaft 13, numeral 14 designates a flange mounted to the machine frame (not shown) and supporting shaft 13, numeral 15 designates a paper guide gap adjusting device, and numeral 8*a* designates an arm which is rotatable about a shaft 10*a* and supports the folding roller 4*a*.

With respect to the paper guide gap adjusting device 15, reference numeral 22 designates a shaft connected to a rotary actuator (motor or handle, e.g.), numeral 18 designates a threaded shaft connected directly to shaft 22 via a coupling 21, numeral 16 designates a base fixed to a frame of the machine (not shown), numerals 17 designate bearings mounted to base 16 and rotatably supporting shaft 18, numeral 19 designates a block internally threaded to shaft 18, numeral 19*a* designates a pin fixed to block 19*a* and located in a recess in lever 12, and numeral 20 designates a spring for damping vibrations of lever 12.

The gap $b_1$ can be adjusted by rotating shaft 22. When shaft 22 rotates, the nut or block 19*a* is moved along threaded lever 12 about shaft 13.

When the cut web is continuously folded by means of the folding blade and the folding rollers, variations in the flow of air around the outer circumference of the folding drum during the folding operation are one factor which determines whether or not a regular pull-out binder will be produced. The paper guides prevent abnormal behavior of the web which would otherwise be caused by this air flow variation during the folding operation.

However, in the heretofore known paper guide device as described above, since the guides are not located proximate the folding rollers during operation, i.e. the gaps between the guides and the folding rollers are rather large, an abnormal behavior at a rear end portion of the web is brought about, and so problems arise in that defects, such as the folding of the edges of the pull-out binder and the like, occur.

SUMMARY OF THE INVENTION

It is therefore one object of the present invention to provide an improved paper guide device in a folding machine of a rotary press, in which abnormal behavior of a paper web during folding is eliminated and defects in product quality such as the folding of edges cf a pull-out binder can be prevented.

Another object of the present invention is to provide an improved paper guide device in a folding machine of a rotary press, in which the contact between folding rollers and paper guides is surely prevented when the machine is clogged with paper, and so sparks are not generated which would otherwise be caused by the overheating of the folding rollers and paper guides upon their contact.

Still another object of the present invention is to provide an improved paper guide device in a folding machine of a rotary press, in which the mechanical parts, such as the folding drum, folding blade and folding rollers are not damaged when the machine is clogged with paper.

According to the present invention, a paper guide device including paper guides is disposed close to folding rollers in a folding machine of a rotary press as spaced from the outer circumference of a folding drum. During normal operation, the paper guides are positioned to allow for minute movement of the folding rollers, but when there is a paper jam forcing the folding rollers apart beyond their normal range of motion, the paper guides move as interlocked with the folding rollers so that paper guides do not come into contact with the folding rollers.

More particularly, the improved paper guide device according to the present invention is characterized as follows:

(1) the gaps between the folding rollers and the paper guides during normal operation have the minimal widths which insure that the folding rollers will not come into contact with the paper guides during normal operation;

(2) when the folding rollers have moved over a distance greater than the width of the gaps mentioned in item (1) due to the occurrence of an anomaly such as a paper jam, the paper guides move jointly with the folding rollers so that the minimal gaps between the folding rollers and the paper guide are maintained;

(3) the paper guides are supported in a slidable or rotatable manner, and by means of an actuator such as a spring or an air-cylinder the paper guides are fixedly held in the state mentioned in item (1) above; and (4) in order to slide or rotate the paper guide during abnormal movement of the folding roller as mentioned in item (3) above, an actuating plate or a roller is provided in an arm rotatably supporting the folding roller.

The paper guide device according to the present invention operates in the following manner.

(1) Owing to the fact that the gaps between the folding rollers and the tip ends of the paper guides during normal operation have minimum widths which will allow minute movement of the folding rollers, the catching of the web between the rollers and paper guides or variations in the flow of air during the folding of the web can be suppressed to a minimum.

(2) Since the paper guides surely move while maintaining a minimum distance from the folding rollers when the folding rollers undergo abnormal movement, the folding rollers and the paper guides never come into contact with each other.

(3) Owing to the operational characteristics set forth in items (1) and (2) above, the amount by which the folding rollers can move apart when clogged with paper can be chosen large.

BRIEF DESCRIPTION OF THE DRAWINGS

The above-mentioned and other objects, features and advantages of the present invention will become more apparent by referring to the following description of preferred embodiments of the invention taken in conjunction with the accompanying drawings.

In the accompanying drawings:

FIG. 1(*b*) is an inclined plan view of the same as viewed in the direction of arrow T in FIG. 1(*a*);

FIG. 2(*b*) is a cross-sectional view of the same taken along line Y—Y in FIG. 2(*a*);

DETAILED DESCRIPTION OF THE PREFERRED EMBODIMENT

Now the present invention will be described in greater detail with respect to a first preferred embodiment shown in FIG. 1 and a second preferred embodiment shown in FIG. 2.

Figure 1:
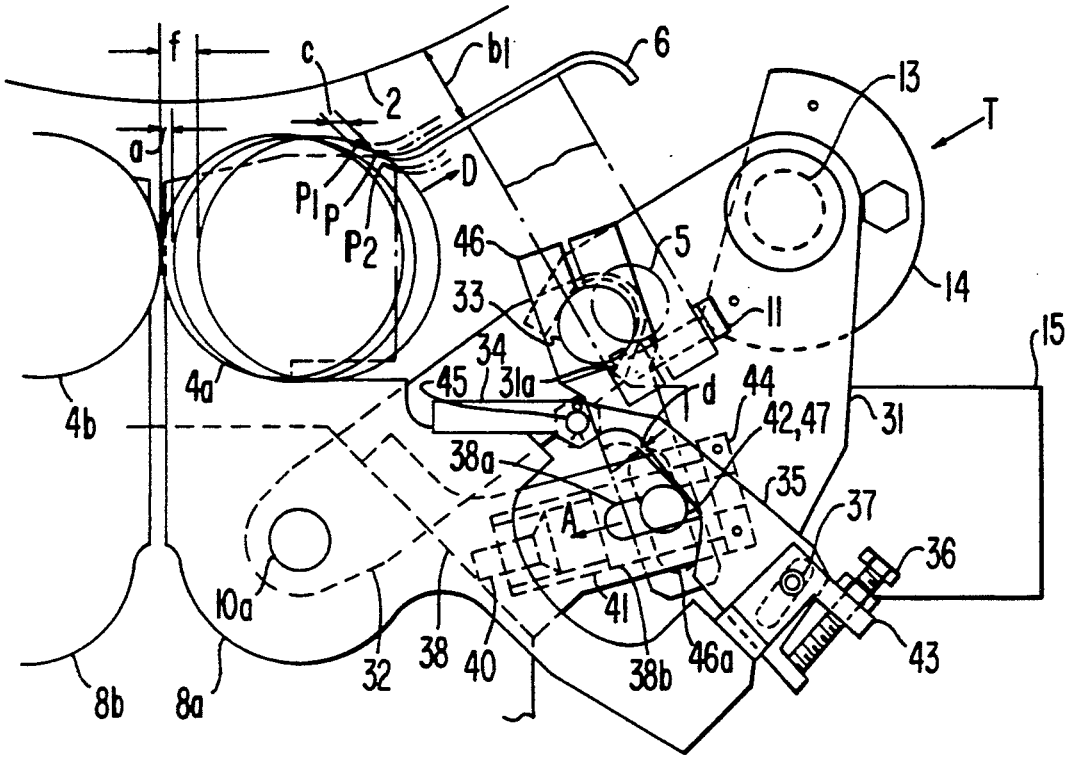
FIG. 1(*a*) is a side view of a paper guide device according to a first preferred embodiment of the present invention.
Figure 1:
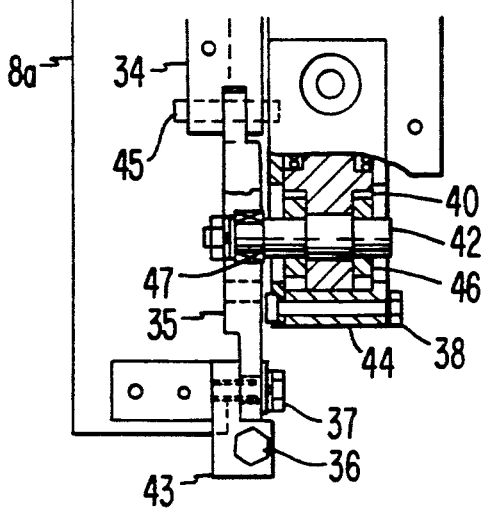
Figure 3:
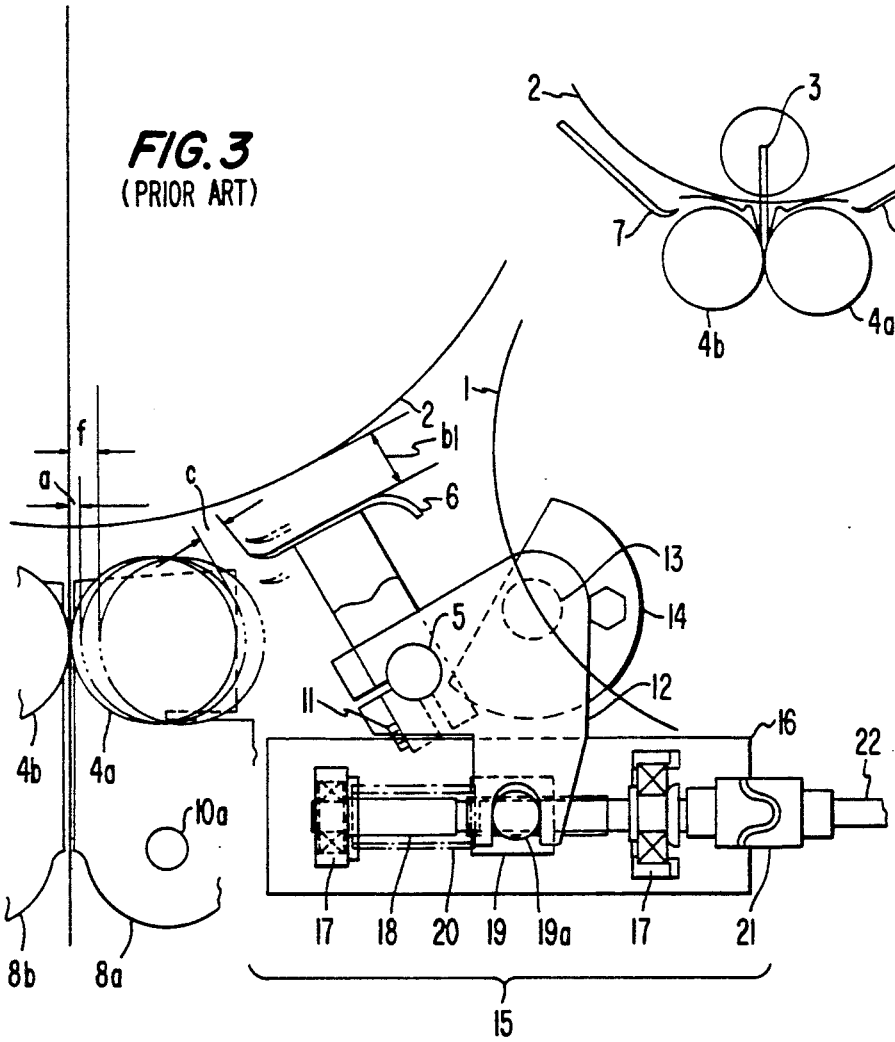
FIG. 3 (PRIOR ART)
FIG. 3 is a side view of a paper guide and a gap adjusting device located to the side of a cutting drum in the prior art.

In the first preferred embodiment shown in FIG. 1, a shaft 33 is integrally mounted to a support shaft 5 of a paper guide 6, is held within a groove 31*a* of a lever 31 that is rotatable about a shaft 13 by a paper guide gap adjusting device 15 of the type shown in FIG. 3, and is rotatably fitted to one end of a link 32 that is swingably mounted to a fulcrum 10*a* of an arm 8*a* supporting a folding roller 4*a*. In addition, on the shaft 33 is fixedly provided a lever 46. Next, a shaft 42 extending through an elongate groove 46*a* of the lever 46 and an elongate groove 38*a* of a bracket 38 intersecting the elongate groove 46*a*, is pressfitted in a shaft 40 which can move in a bore 38*b* of the bracket 38 against a resilient force of a spring 41. And, at one end of the shaft 42 is mounted a roller 47. On the other hand, on the arm 8*a* is mounted an actuating plate 35 by means of brackets 34 and 43, and a gap d is preset between the actuating plate 35 and the roller 47. To the bracket 34 is mounted one end of the actuating plate 35 via a pin 45.

The width of the gap d is set by rotating the actuating plate 35 about the pin 45 by means of a screw 36 disposed between the bracket 43 and the other end of the actuating plate 35 and, after rotation, fixing the same. When setting the gap c between the folding roller 4*a* and the paper guide 6, the support shaft 5 of the paper guide 6 is rotated by loosening a bolt 11 and then it is fixed again in place by fastening the bolt 11. The widths of the gaps d and c are set with the width of the gap a of the folding roller 4*a* corresponding to the thickness of the maximum number of pages which is to be completed.

The widths of the gaps d and c are chosen such that minute movement of the folding roller 4*a* and the arm 8*a* during normal operation may be allowed; and even when d=0, normally a gap c of about 1 mm can be maintained.

If the folding roller 4*a* should move to the right as viewed in FIG. 1 due to the clogging of the nip with paper, then the arm 8*a* would swing in the clockwise direction jointly with the brackets 34 and 43 and the actuating plate 35. Accordingly, the gap d between the actuating plate 35 and the roller 47 would decrease gradually. When the folding roller 4*a* has moved to a position at which the gap becomes f, the above-mentioned gap d between the actuating plate 35 and the roller 47 becomes 0, and thereafter the shaft 40 is moved in the direction of arrow A, against the resilient force of the spring 41, by the actuating plate 35 via the roller 47. Accordingly, the lever 46 also rotates about the shaft 33, and the paper guide 6 integrally fixed to the shaft 33 rotates in the direction of arrow D while the width of gap c is maintained nearly at 1 mm. Therefore, the folding roller 4*a* and the paper guide 6 will not contact one another.

The adjustment of the gap $b_1$, between the paper guide 6 and the folding drum 2, is carried out by rotating the lever 31 with the aid of the paper guide gap adjusting device 15. If the lever 31 rotates, the center axis of the shaft 33 rotates about the fulcrum point 10*a* jointly with the link 32. On the other hand, an angle of tilt of the lever 46 changes by an amount corresponding to the movement of the shaft 33 relative to position of the shaft 42. As a result of these changes in the position of the center of the shaft 33 and in the angle of tilt of the lever 46, the position and inclination of the paper guide 6 changes. The tip end of the paper guide is moved from position p to position $p_1$ or $p_2$ by the multi-contact linkage such that the width of the gap c between the folding roller and the paper guide does not change largely.

Figure 2A:
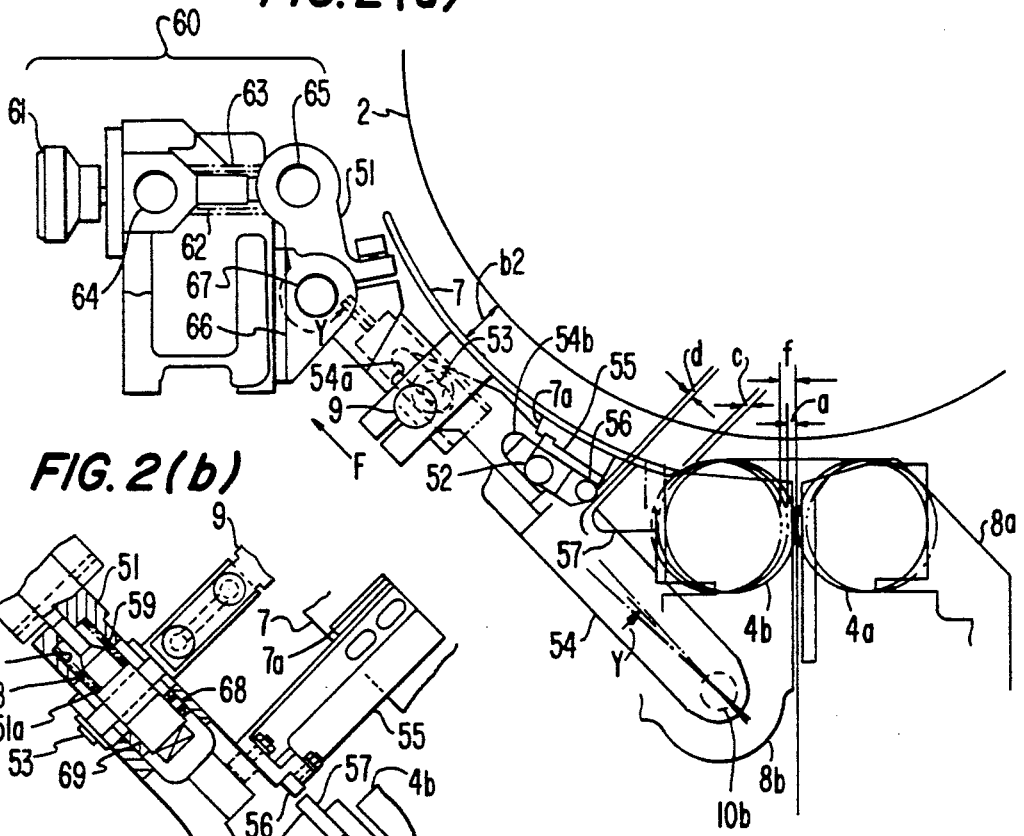
FIG. 2(*a*) is a side view of a paper guide device according to a second preferred embodiment of the present invention.
Figure 2B:
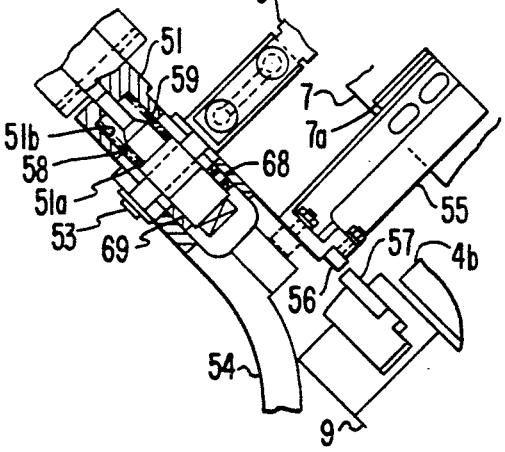
Figure 4:
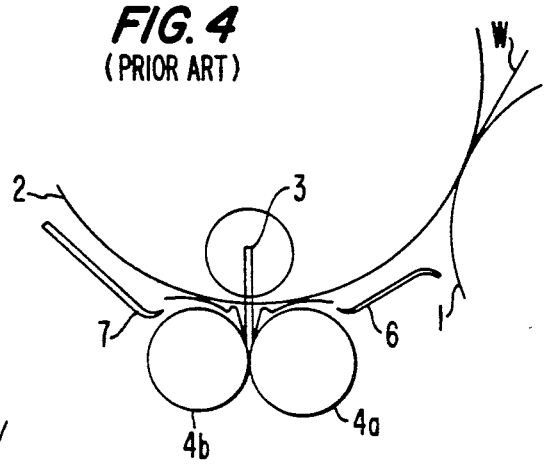
FIG. 4 (PRIOR ART)
FIG. 4 is a schematic diagram showing the arrangement of a cutting drum, a folding drum, folding rollers and paper guides in a folding machine.

FIG. 2 shows a second preferred embodiment of a paper guide device, in which a similar mechanism is utilized.

In FIG. 2, a lever 51 can be rotated about a shaft 67, supported on a bracket 66, by means of a paper guide gap adjusting device 60, which comprises a trunnion 64 supporting a screw shaft 62 of a handle 61, a trunnion 65 threadedly engaged with the screw shaft 62, and a spring 63 disposed between the trunnions 64 and 65. A paper guide 7 and its support shaft 9 are integrally fixed to a shaft 53. The shaft 53 extends through an elongate groove 51*a* at an end of the lever 51 and through an elongate groove 54*a* of a link 54 which is rotatable about a fulcrum 10*b*. The shafts 9 and 53 are also rotatably mounted to a shaft 58 which is movable within a bore 51*b* of the lever 51 against a resilient force of a spring 59.

In addition, a roller 52 is mounted to a bracket 55 on a seat 7*a* of the paper guide 7 and is fitted in another elongate groove 54*b* of the link 54, whereby the paper guide 7 is rotatable about the shaft 53.

On the other hand, an arm 8*b* supporting a folding roller 4*b* is provided with an actuating plate 57, and a gap d between the actuating plate 57 and another roller 56 on the bracket 55 is adjustably set by moving the actuating plate 57 up or down.

The width of a gap c between the paper guide 7 and feed roller 4*b* can be adjusted by moving the shaft 58 urged by the spring 59, that is, by moving the shaft 53 and the paper guide 7 by turning an adjusting screw 69.

The gaps d and c are set with the width of gap a corresponding to the thickness of the maximum number of pages to be completed.

The widths of the gaps d and c are determined in a manner similar to that in the first preferred embodiment.

When the folding device is clogged with paper, and the folding roller 4*b* moves such that the gap d becomes 0, the actuating plate 57 and the roller 56 come into contact with each other. Thus, the roller 56 is pushed and the shaft 53 is moved via the paper guide 7 in the direction of arrow F, against a resilient force of the spring 59, so that the folding roller 4*b* and the paper guide 7 will not contact each other and the gap c of nearly 1 mm is maintained.

The adjustment of the gap $b_2$ between the paper guide 7 and the folding drum 2 is carried out by rotating the lever 51 by turning the handle 61 of the paper guide gap adjusting device 60.

As a result of the rotation of the lever 51, the center of the shaft 53 rotates about the shaft 67. At the same time, the link 54 also rotates about the fulcrum 10*b*, and the inclination of the paper guide 7 also changes. However, owing to the design of this multi-contact linkage, the gap c will not change largely.

As will be apparent from the detailed description of the preferred embodiments above according to the present invention, during normal operation the paper guides are positioned to allow for minute movements of the folding rollers, but when there is a paper jam forcing the folding rollers apart beyond their normal range of motion, the paper guides move as interlocked with the folding rollers so that paper guides do not come into contact with the folding rollers. Owing to the above facts, the following advantages are obtained.

(1) Since the gaps between the folding rollers and the paper guides during normal operation are narrow, the web is not likely to enter the gaps and there is little variation in the flow of air over the web. Accordingly, abnormal behavior of the web during folding is eliminated, and problems in product quality, such as the edges of a pull-out binder being folded, are prevented.

(2) As contact between the folding rollers and the paper guides when the device is clogged with paper can be surely prevented, sparks do not occur which would otherwise be caused by such contact. Therefore, the present invention is safe.

(3) Since the distance over which the folding rollers can move when clogged with paper can be quite large, the mechanical parts of the machine such as the folding drum, folding blade or folding rollers will not be damaged.

While a principle of the present invention has been described above in connection with preferred embodiments of the invention, it is intended that all matter described in the specification and illustrated in the accompanying drawings be interpreted as illustrative of and not as a limitation on the invention as set forth in the appended claims.

What is claimed is:

1. In a folding machine of a rotary press having a folding drum and folding rollers spaced from the outer circumference of the drum, a paper guide device for guiding paper along the folding drum and toward the folding rollers, said paper guide device comprising:

an arm rotatably supporting one of the folding rollers in the folding machine, said arm being movably mounted in the folding machine to allow the roller supported thereon to move toward and away from the other of the folding rollers;

a paper guide extending alongside the outer circumference of the folding drum, said paper guide having a tip end adjacent and spaced from said one of the folding rollers such that said paper guide guides paper traveling along the outer circumference of the folding drum toward the folding rollers;

an actuating plate connected to said arm so as to move therewith as said one of the folding rollers moves toward and away from the other of the folding rollers; and a cam roller connected to said paper guide and in operative camming engagement with said actuating plate thereby interlocking said arm to said paper guide.

2. The paper guide device in a folding machine of a rotary press as claimed in claim 1, and further comprising means for moving said actuating plate relative to said arm and for fixing said actuating plate in position relative to said arm such that said actuating plate can be repositioned relative to said cam roller, said actuating plate being fixable in a position at which when said one of the folding rollers moves a distance greater than a predetermined distance away from the other of the folding rollers, the actuating plate cams said cam roller to move said paper guide to a position at which the tip end thereof remains spaced from said one of the folding rollers.

3. The paper guide device in a folding machine of a rotary press as claimed in claim 1, and further comprising paper guide gap adjusting means for adjusting the spacing between said paper guide and the outer circumference of the folding drum.

4. The paper guide device in a folding machine of a rotary press as claimed in claim 2, and further comprising paper guide gap adjusting means for adjusting the spacing between said paper guide and the outer circumference of the folding drum.

5. The paper guide device in a folding machine of a rotary press as claimed in claim 1, wherein a shaft is fixedly connected to said paper guide, a link is rotatably mounted at one end thereof to said arm, and a lever is pivotably mounted in the folding machine, at least one of said link and said lever defining a slot therein in which said shaft is received, and the other of said link and said lever being connected to said shaft, said link and said lever constituting an articulatable linkage supporting said paper guide via the shaft fixedly connected thereto.

* * * * *